US009975216B2

(12) United States Patent
Solenthaler et al.

(10) Patent No.: US 9,975,216 B2
(45) Date of Patent: May 22, 2018

(54) DEVICE AND METHOD FOR DISPENSING DRY ICE SNOW

(75) Inventors: Jürg Solenthaler, Bronschhofen (CH); Max Zeintl, Wil (CH)

(73) Assignee: DESISA GMBH, Wil (CH)

( * ) Notice: Subject to any disclaimer, the term of this patent is extended or adjusted under 35 U.S.C. 154(b) by 1157 days.

(21) Appl. No.: 13/817,072

(22) PCT Filed: Aug. 16, 2011

(86) PCT No.: PCT/EP2011/064070
§ 371 (c)(1),
(2), (4) Date: Feb. 14, 2013

(87) PCT Pub. No.: WO2012/022735
PCT Pub. Date: Feb. 23, 2012

(65) Prior Publication Data
US 2013/0139853 A1 Jun. 6, 2013

(30) Foreign Application Priority Data
Aug. 16, 2010 (EP) ..... 10172867

(51) Int. Cl.
*B24C 1/00* (2006.01)
*B24C 7/00* (2006.01)

(52) U.S. Cl.
CPC ..... *B24C 1/003* (2013.01); *B24C 7/0069* (2013.01)

(58) Field of Classification Search
CPC ..... B24C 7/0069; B24C 1/003
See application file for complete search history.

(56) References Cited

U.S. PATENT DOCUMENTS

| | | | | |
|---|---|---|---|---|
| 1,272,222 | A | 7/1918 | Clayton | |
| 3,670,516 | A | 6/1972 | Duron et al. | |
| 3,786,644 | A | 1/1974 | Rich et al. | |
| 4,735,135 | A | 4/1988 | Walker | |
| 5,947,800 | A * | 9/1999 | Fring | B24C 7/0046 451/101 |
| 7,673,638 | B1 | 3/2010 | Boynton | |
| 2003/0064665 | A1 | 4/2003 | Opel | |
| 2004/0121711 | A1 * | 6/2004 | Opel | B24C 1/003 451/75 |
| 2006/0178092 | A1 * | 8/2006 | Spivak | B24C 1/003 451/99 |

FOREIGN PATENT DOCUMENTS

| | | |
|---|---|---|
| DE | 102008025361 | 3/2009 |
| EP | 1769886 | 4/2007 |
| EP | 1843874 | 10/2007 |
| FR | 2911809 | 8/2008 |
| WO | 2006/083890 | 8/2006 |

* cited by examiner

*Primary Examiner* — Alexander Markoff
(74) *Attorney, Agent, or Firm* — Davis & Bujold PLLC; Michael J. Bujold

(57) ABSTRACT

The invention relates to a device for dispensing dry ice snow, comprising a storage container (10) for receiving dry ice snow and vibrating means (102) and/or scraping means (103). An insert plate (105) with through-openings (106) is provided. The insert plate is located in the interior of the storage container (10), divides the storage container (10) into two regions, and can be set vibrating by means of the vibrating means (102) and/or scraped by means of the scraping means (103).

3 Claims, 8 Drawing Sheets

DEVICE AND METHOD FOR DISPENSING DRY ICE SNOW

The invention relates to a device and a method for dispensing dry ice snow having the features of the preamble of the independent patent claims.

It is known to clean surfaces by means of dry ice granulates ("pellets"). The pellets are compressed and/or compacted dry ice.

To suck pellets from a storage container, it is known to connect a spray gun to a compressed air line and to suck up the pellets in accordance with the Venturi principle. The pellets are thrown against a surface to be cleaned through a pipe having a blasting gun provided at the free end of the pipe.

The compressed air can be used simultaneously to move the intake fitting to and fro by means of a pneumatic arrangement. Such a method and a corresponding device are disclosed for example in EP 1 769 886.

It is also known to clean surfaces by means of dry ice snow (also called "CO2 snow", referred to as "snow" hereinafter).

In the present application, dry ice snow is understood to be an accumulation of loosely connected CO2 crystals. The density ratio of pellets and snow is approximately 1:⅔.

Due to the lower kinetic energy of the carbon dioxide particles, CO2 snow blasting is a much less abrasive method than pellet blasting and is therefore suitable for cleaning sensitive surfaces. By contrast, pellet blasting is more suitable with heavier soiling and for more abrasive cleaning. The two methods consequently complement one another.

The snow can also be thrown ("blasted") against a surface to be cleaned through a pipe having a blasting gun provided at the free end of the pipe.

Whereas, when cleaning with pellets, the blasting agent can generally be pre-produced, when cleaning with dry ice snow the CO2 snow is generally produced continuously as part of the overall process. The snow is thus prevented from clumping together. Such a method and a corresponding device are known for example from EP 1 843 874.

It has been found however that the cleaning effect of freshly produced dry ice snow is not as good. Dry ice snow that has been left to stand for a certain period of time is grainy and better suited for cleaning.

On the other hand, CO2 snow, in particular after relatively long periods of storage, tends to clump due to gravitational force, heating and/or absorption of condensate water and is consequently more difficult to convey or can no longer be conveyed.

The snow can also be prevented from clumping together by swirling the dry ice in a nozzle and by only producing the snow as the dry ice exits from the nozzle, as is disclosed for example in EP 1 843 874.

In addition, the dry ice snow container can be vibrated, as disclosed in U.S. Pat. No. 3,670,516, or the conveyed dry ice is subject to an electric field, as disclosed in U.S. Pat. No. 3,786,644, so that electrostatically charged dry ice particles are repelled from one another.

According to the prior art, devices for delivering dry ice pellets and dry ice snow differ fundamentally, and therefore, if both methods are desired for a surface cleaning process, two different systems have to be created.

According to the prior art, it is therefore difficult to combine the two techniques, in particular because there is a risk when conveying snow that the snow will clump in the conveying device, consequently blocking the lines and/or preventing the snow from flowing on continuously. It may also be that, in a system that conveys the snow by means of compressed air, the snow collects around the intake region, where it clumps and can no longer be extracted.

The object of the present invention is therefore to avoid the disadvantages of the known prior art, and in particular to therefore create a device and a method for delivering snow and for delivering pellets or snow selectively, wherein the snow is prevented from clumping and/or is loosened up again. The device according to the invention and the method according to the invention should also make it possible to create a device in the simplest manner possible, which can be used in a space-saving and cost-effective manner. An option for easily and cost-effectively retrofitting an existing device for delivering dry ice pellets with a device for delivering dry ice snow and/or for delivering dry ice snow or dry ice pellets is also sought.

This object is achieved in accordance with the invention by devices and methods having the features in the independent patent claims.

A first aspect of the invention concerns an insert plate for a device for delivering dry ice. The plate is characterized in that it is provided with through-openings. The plate, which can be inserted into a storage container for receiving dry ice snow, is used primarily to loosen up and meter dry ice snow. The dry ice snow lies on the plate and can fall in portions through the through-openings. The dry ice snow is therefore prevented from clumping together.

The insert plate may have a flat, self-supporting structure and may be board-like or sheet-like.

The plate may also have a frame structure, in which a screen or a perforated sheet is received.

The plate may be provided with a bearing element, in particular a bearing ring. The bearing element is preferably not connected fixedly to the plate.

If the plate is inserted into a device for cleaning using dry ice, a bearing element placed on the plate thus ensures in particular that the plate, which is moved upwardly by compressed air for example, is pressed downwardly again as a result of the gravitational effect of the bearing element. Since the bearing element is not connected to the plate, or at least is not connected rigidly to the plate, it is catapulted vertically upwardly as the plate moves upwards. The fact that the bearing element falls back onto the plate ensures that it reassumes its starting position. The bearing element contacts the insert plate as it falls back, and the jolt produced causes dry ice arranged on the plate to fall through the through-openings. At the same time, dry ice snow located between the bearing element and the insert plate is pressed through the through-openings.

The insert plate can also be mounted fixedly in an inner container, which is movable with respect to the storage container.

The plate is preferably provided with a contact element, which is acted on by a vibrating means as the dry ice snow is conveyed. The contact element advantageously has a contact face for this purpose.

The insert plate may also be connected to an air intake pipe. The air intake pipe may be an elongate, solid element with openings at both ends, which is hollow inside. The pipe may be cylindrical and/or may have at least one cross-sectional area that is constant along the longitudinal axis. The intake pipe provides a preferred path for air sucked up with the dry ice.

In a preferred embodiment the insert plate is connected to a contact member, which has a contact face. In this case the plate can be vibrated by direct contact of the contact face.

The plate may also have a mandrel, which protrudes into the air intake pipe and/or into the outlet opening. The mandrel ensures axial guidance.

The insertion of the plate ensures that a device for cleaning using dry ice pellets, as described for example in EP 1 769 886, is retrofitted with a device for cleaning using dry ice snow. A plate inserted into such a device prevents dry ice snow, which has been filled into said device instead of dry ice pellets, from clumping together during the conveying process, specifically as a result of the sieving effect of the plate. At the same time, the loosened snow is conveyed through the through-openings due to the vibratory movement.

If the plate can be removed, it is possible to change back to operation with dry ice pellets in a simple manner. The combination of dry ice pellet cleaner and insert plate thus constitutes a device for cleaning using both dry ice pellets and dry ice snow.

In a preferred embodiment the plate has a sieve or grate, which is surrounded by a frame for example. The size and arrangement of the through-openings influence the amount of material allowed to pass through and the spatial distribution of the dry ice snow. The size and arrangement of the through-openings and of the plate are preferably adapted to the geometry of the storage container and/or of the outlet opening.

The invention further relates to a device for dispensing dry ice snow as material to be conveyed, comprising a storage container for receiving dry ice snow and comprising a vibrating and/or stripping means.

The device is characterized in that an insert plate with through-openings, in particular as described above, is provided. The plate is located inside the storage container and divides the storage container into two regions, wherein the dry ice snow, which in particular is unsieved and relatively compact, is located in the first region and snow, which has been conveyed through the plate and in particular has been loosened, is located in the second region. For example, the storage container is suitable for receiving dry ice snow produced beforehand or dry ice pellets produced beforehand.

It is possible for the insert plate to be located permanently in the storage container, that is to say such that it cannot be removed, and also for the plate to be a plate that can be inserted and removed.

The insert plate can be vibrated by means of the vibrating means and/or can be stripped by means of the stripping means, such that the dry ice snow penetrates the through-openings and does not remain on the plate.

The vibrating means may be a mechanically, hydraulically, pneumatically, electromagnetically or piezoelectrically driven vibrating means.

For example, the insert plate can be vibrated by mechanical impacts or by means of ultrasound.

The stripping means may for example be a rasping tool, a doctor blade or a brush, by means of which the snow is pressed through the through-openings, similarly to a passevite.

With an insert plate mounted fixedly in an inner container, the plate can be vibrated by vibrating the inner container.

In a preferred embodiment of the invention the storage container is manufactured from thermally insulating material, whereby the melting or sublimation process of the snow is slowed considerably. The dry ice snow therefore has to be replenished less frequently.

The setting of the vibration frequency and/or the stripping frequency makes it possible to meter the amount of snow conveyed through the plate per unit of time.

In a preferred embodiment of the above-described device, the device also has a device for producing dry ice.

The device is preferably so small and light that it can be transported by hand. To this end, the device has castors for example or can be transported on a trolley.

The above-stated problem is also solved by a device for selectively dispensing either dry ice snow or dry ice pellets as material to be conveyed, comprising a storage container for receiving the material to be conveyed, at least one selecting element and a vibrating and/or scraping means. It is characterized in that a first type of conveyance for dry ice snow and a second type of conveyance for dry ice pellets can be selected by means of the selecting element.

The at least one selecting element may be an insert plate with through-openings, in particular as described above.

In a preferred embodiment of a device as described above comprising an insert plate, the vibrating means is an impact device acting directly or indirectly on the plate.

The insert plate can be fastened or supported in a sprung manner.

The impact device may comprise a hammer, which for example acts periodically on the plate and vibrates the plate, which for example is fastened in a sprung manner. Dry ice snow can thus trickle through continuously.

Alternatively or in addition, the storage container itself can be vibrated by means of the vibrating means. A vibrating means attached outside the storage container can vibrate the storage container. At the same time, a plate that is preferably fastened in a sprung manner can be vibrated.

An externally attached vibrating means could be an impact device, which in particular acts on the storage container by impacting it periodically.

In a preferred embodiment of the device the vibration frequency is preferably between 1 and 10 Hz. The vibration amplitude of the plate is preferably between 1 and 20 mm. The amount of snow conveyed per unit of time can be adapted by adjusting the vibration frequency and the vibration amplitude.

In a preferred embodiment of the device the storage container is connected to a compressed air device, by means of which the material to be conveyed can be dispensed.

To this end, the container may be provided with a conveying line, in particular a flexible pipe, which is connected at one end to the container and at the other end to a compressed air gun. A negative pressure can be generated in the pipe via the gun by means of the compressed air device, whereby the snow or dry ice pellets conveyed through the insert plate can be sucked up for example and dispensed by the compressed air gun.

The conveying line may be designed as a freely movable intake fitting and can be controlled using an oscillation valve. The intake fitting may then act on the insert plate or the storage container as a vibrating means vibrating against a contact face.

Alternatively to the insert plate, the at least one selecting element for determining pellets as the material to be conveyed may be a mixing element, which is located in particular completely inside the storage container and is preferably movable to and fro, parallel to an axis.

For example, the mixing element is a bar or a rod, to which radially star-shaped transverse elements are attached perpendicularly to the axis and are used for centering purposes. The mixing element can prevent dry ice pellets from sticking together and blocking the device. The mixing element may also have a contact face, against which a movable intake fitting impacts during operation and in doing so breaks up dry ice pellets or clumps of dry ice pellets.

The mixing element also advantageously comprises a mandrel, which reaches into the intake fitting, prevents the pellets in the intake fitting from causing a blockage, and keeps free the intake opening of the intake fitting.

In a further advantageous embodiment, the mixing element is connected to an inner container.

If a user decides to use a different selecting element and for example removes the mixing element so as to insert an insert plate into the container, he can thus remove the rest of the pellets remaining in the container with the mixing element and the inner container. Conversely, he can fill identical pellets into the container with the mixing element if he has already introduced these into the inner container.

The same applies for the filling and removal of dry ice snow when the insert plate is connected to an inner container.

In a further preferred embodiment of the device, a switch attached to the device is provided as a selecting element and sets the vibrating and/or scraping means in accordance with the desired type of conveyance. For example, a specific vibration frequency and/or vibration amplitude can be set for the conveyance of dry ice snow and a different vibration frequency and/or vibration amplitude can be set for the conveyance of dry ice pellets.

The device may also be equipped with two storage containers arranged in parallel, of which one is adapted for receiving and conveying pellets and the other is adapted for receiving and conveying dry ice snow. For example, a mixing element is arranged in one container and an insert plate is arranged in the other container. The device is used for conveying pellets or dry ice snow selectively.

In a further preferred embodiment of the device, the device is provided with an extraction device. For example, dry ice snow can be blasted onto a surface, for example the interior of a vehicle, whilst at the same time the sublimated CO2 gas and the dirt particles detached by the blasting are extracted. The extraction device is arranged such that the dry ice jet can be blasted where possible in a region that is within reach of the extraction device. The arrangement of the dry ice blasting unit and extraction device or fan is preferably selected such that the detached soiling can be reached as directly as possible from the interior, for example the interior of the vehicle or the engine chamber.

In the method according to the invention for dispensing dry ice snow, dry ice snow located in a storage container is conveyed by means of an insert plate with through-openings vibrated by vibrating means or scraped by a scraping means, in particular in accordance with the above description. The snow thus conveyed could, for example, be dispensed by means of a compressed air arrangement generating a negative pressure, as described above.

With the method according to the invention for selectively dispensing either dry ice snow or dry ice pellets, either dry ice snow or dry ice pellets are selected as material to be conveyed and deposited in particular in the storage container in a first step. The type of conveyance is determined in accordance with the selection of the material to be conveyed. The material to be conveyed located in the storage container can then be conveyed and dispensed in accordance with the selected type of conveyance.

The selection of the type of conveyance lies for example in the fact that a mixing element is inserted if dry ice pellets are selected as material to be conveyed, or a plate with through-openings, as described above, is inserted if dry ice snow is selected.

The type of conveyance is accordingly the vibration of a mixing element or the vibration of an insert plate with through-openings by a vibrating means, as described above for example.

A compressed air arrangement is preferably used for the dispensing process, wherein a negative pressure is in particular generated in the storage container to this end.

In accordance with the invention an insert plate with through-openings, in particular as described above, is used to convey dry ice snow in a device for cleaning using dry ice. With the use of such a plate in a unit known per se, this unit can easily be retrofitted for an alternative application, namely the cleaning of sensitive surfaces, or a cleaning device with dry ice pellets is upgraded to a cleaning device using both dry ice pellets and dry ice snow.

The object is also achieved in accordance with the invention by a method for cleaning using dry ice snow, wherein a surface is blasted with dry ice snow, in particular by means of a device as described above. At the same time, detaching dirt particles and sublimated gas are extracted by means of an extraction device.

The method is particularly suitable for cleaning delimited interior spaces such as the engine chamber in a vehicle or aircraft or the interior or cabin of a vehicle or aircraft.

For this purpose, a fragrance and/or a care product may be added to the dry ice.

The invention will be explained in greater detail hereinafter in exemplary embodiments on the basis of the drawings, in which.

Figure 3A:
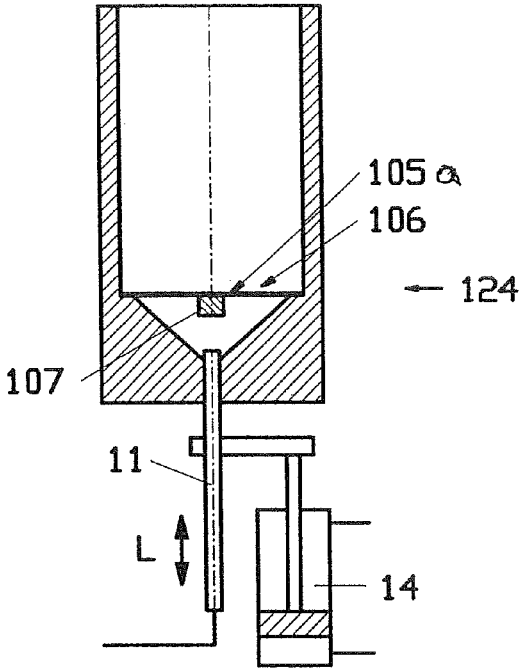
Figure 3B:
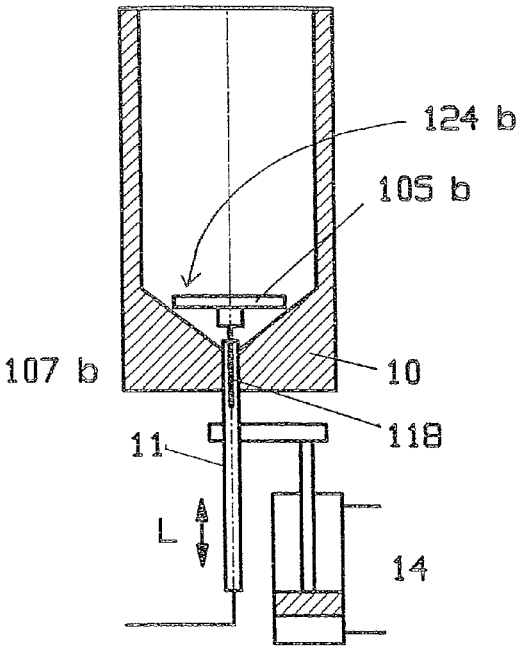
Figure 3C:
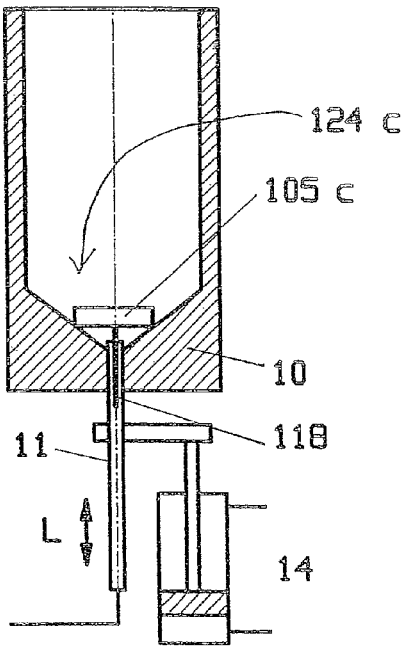
Figure 4:
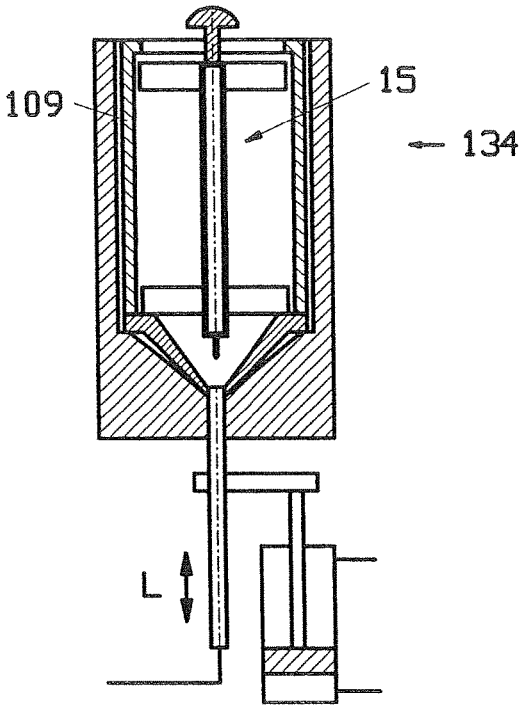
Figure 5:
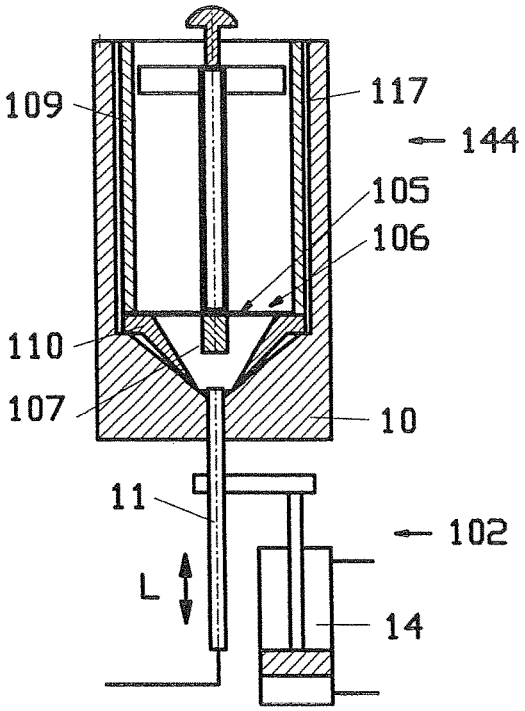
Figure 6:
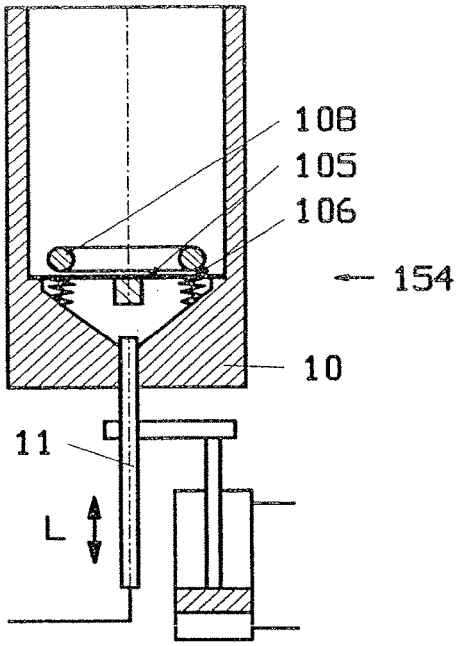
Figure 7:
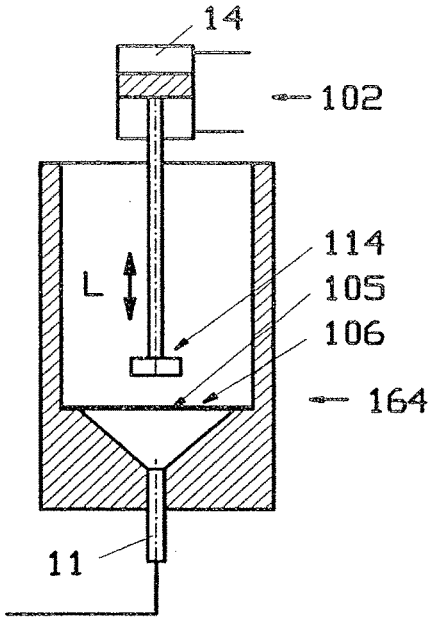
Figure 8:
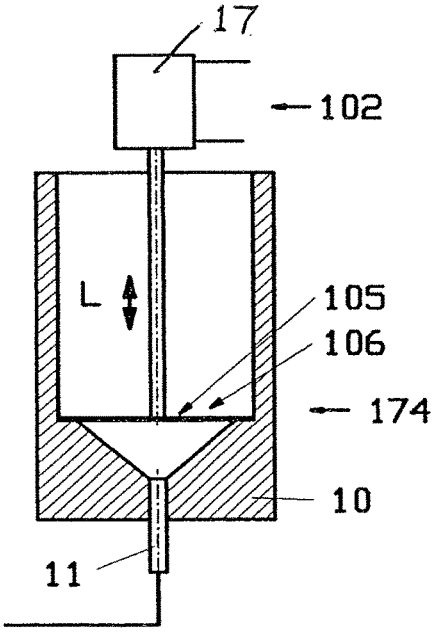
Figure 9:
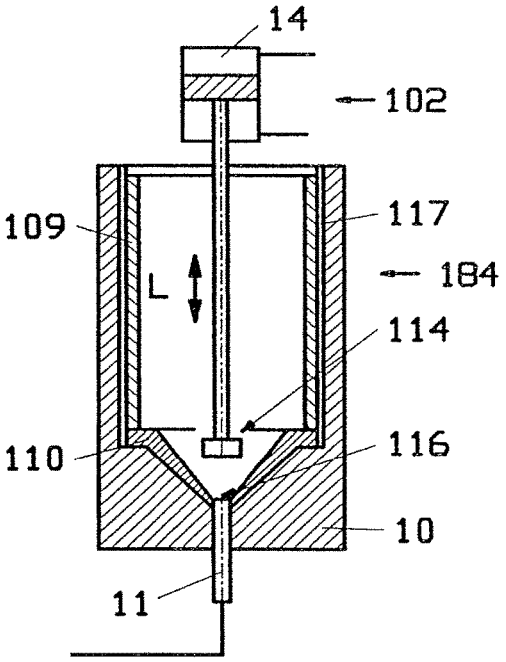
Figure 10:
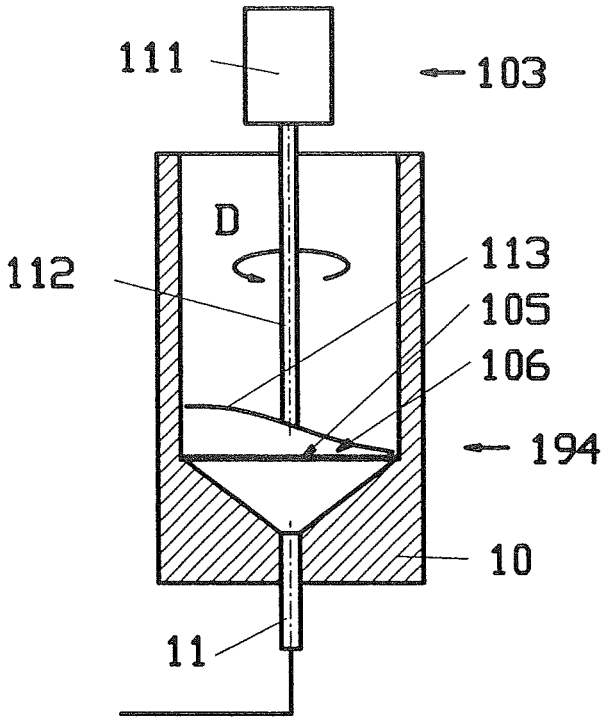
Figure 11:
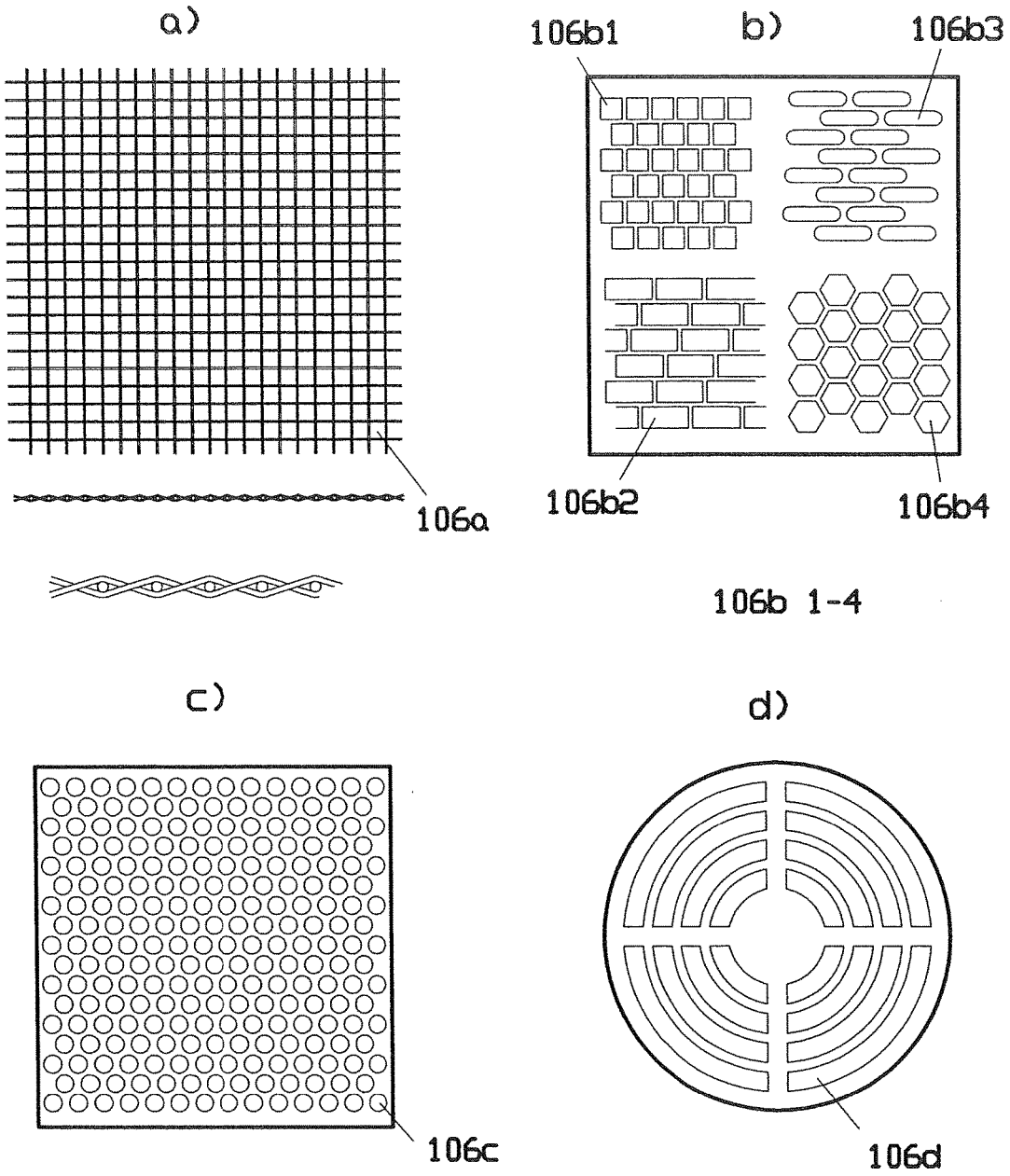
Figure 12:
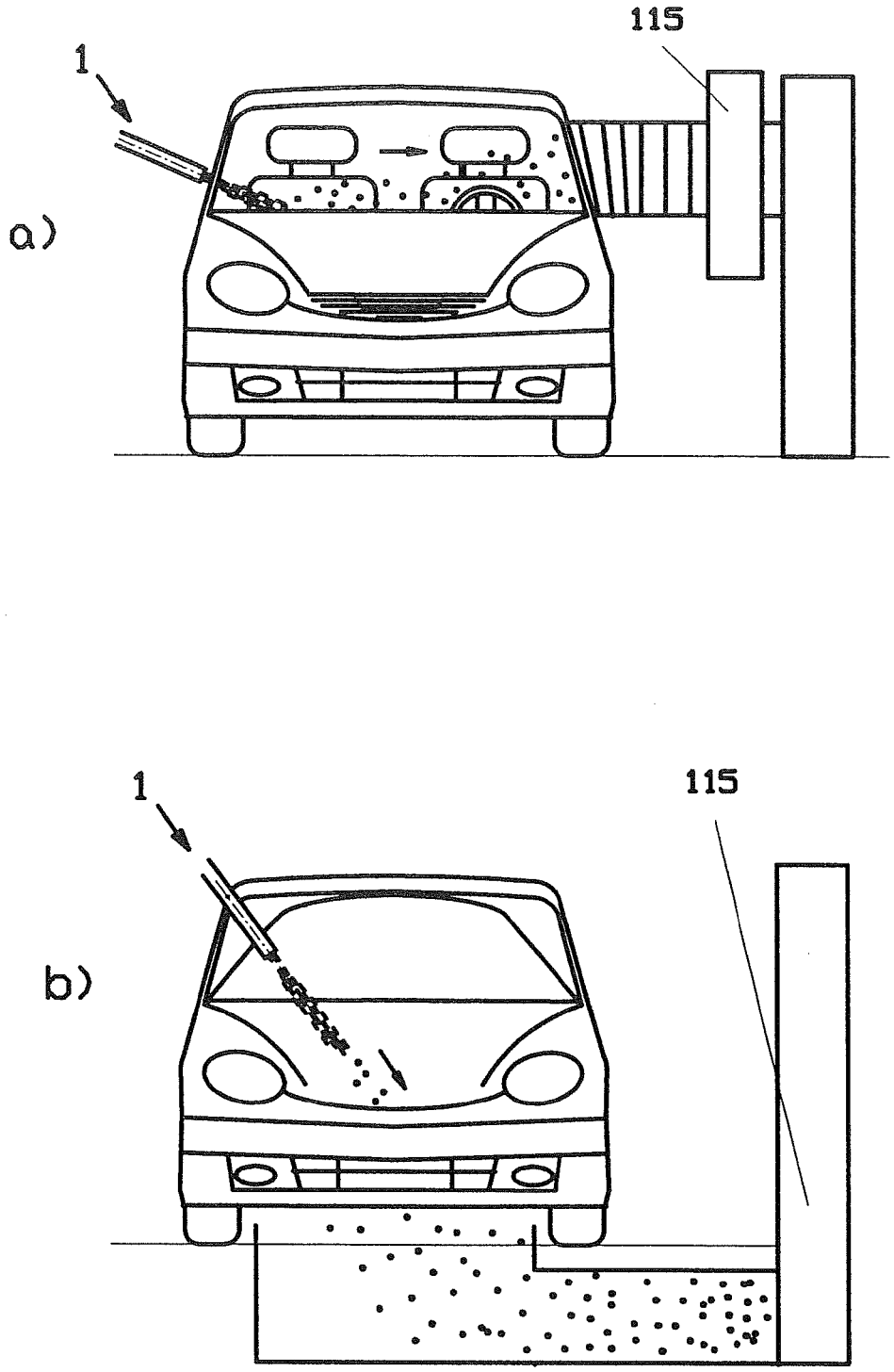
Figure 13A:
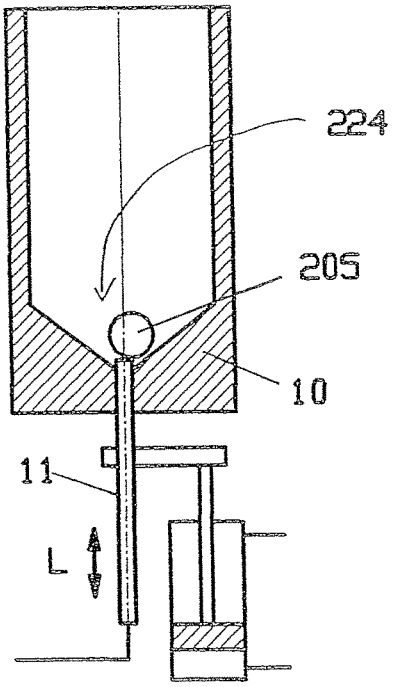
Figure 13B:
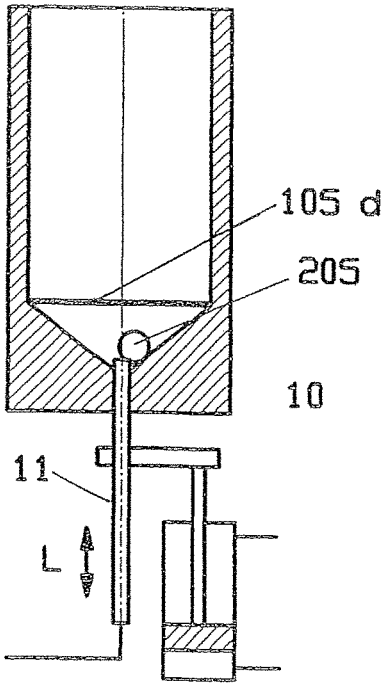
Figure 14A:
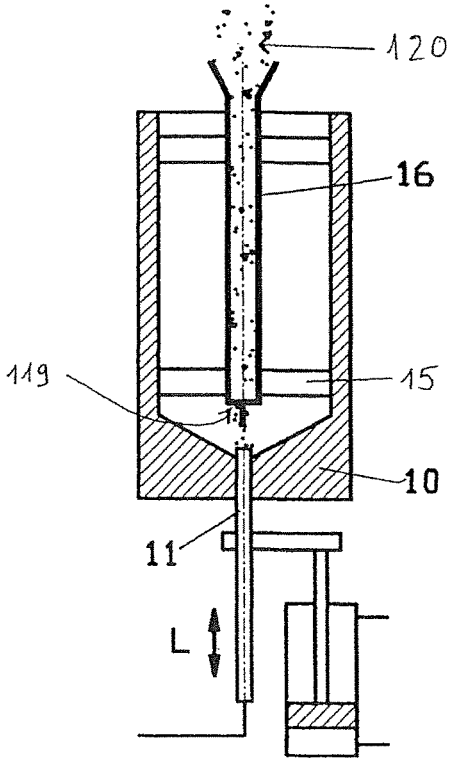
Figure 14B:
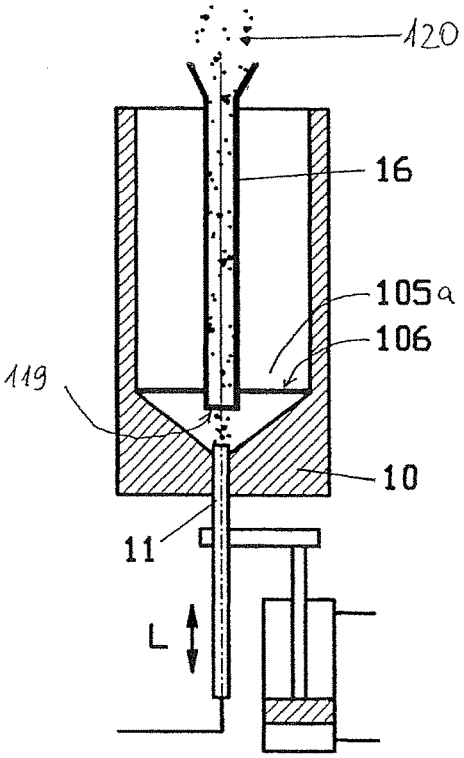

FIG. 3*a* shows a schematic illustration of a storage container of a device according to the invention with an insert plate with through-openings;

FIG. 3*b* shows a schematic illustration of a storage container of a device according to the invention with a second variant for an insert plate;

FIG. 3*c* shows a schematic illustration of a storage container of a device according to the invention with a third variant for an insert plate;

FIG. 4 shows a schematic illustration of the storage container of a device according to the invention for cleaning using dry ice pellets with an inner container;

FIG. 5 shows a schematic illustration of a storage container of a device according to the invention with an insert plate with through-openings in an inner container;

FIG. 6 shows a schematic illustration of a storage container of a device according to the invention with an insert plate with through-openings provided with a bearing ring;

FIG. 7 shows a schematic illustration of a storage container of a device according to the invention with an insert plate with through-openings and a vibrating means acting from above;

FIG. 8 shows a schematic illustration of a storage container of a device according to the invention with an insert plate with through-openings and a vibrating means acting from above;

FIG. 9 shows a schematic illustration of a storage container of a device according to the invention for cleaning using dry ice with an inner container that can be vibrated, wherein the vibrating means acts from above;

FIG. 10 shows a schematic illustration of a storage container of the device according to the invention with a scraping means;

FIG. 11 shows a schematic illustration of different variants of through-openings;

FIG. 12 shows a schematic illustration of a device according to the invention for cleaning using dry ice snow with an extraction device with two arrangement variants a) and b);

FIG. 13*a* shows a schematic illustration of a storage container of a further device according to the invention for cleaning using dry ice pellets and dry ice snow;

FIG. 13*b* shows a schematic illustration of a storage container of a further device according to the invention for cleaning using dry ice snow;

FIG. 14*a* shows a schematic illustration of a storage container of a further device according to the invention for cleaning using dry ice pellets and blasting means;

FIG. 14*b* shows a schematic illustration of a storage container of a further device according to the invention for cleaning using dry ice snow and blasting means.

Figure 1:
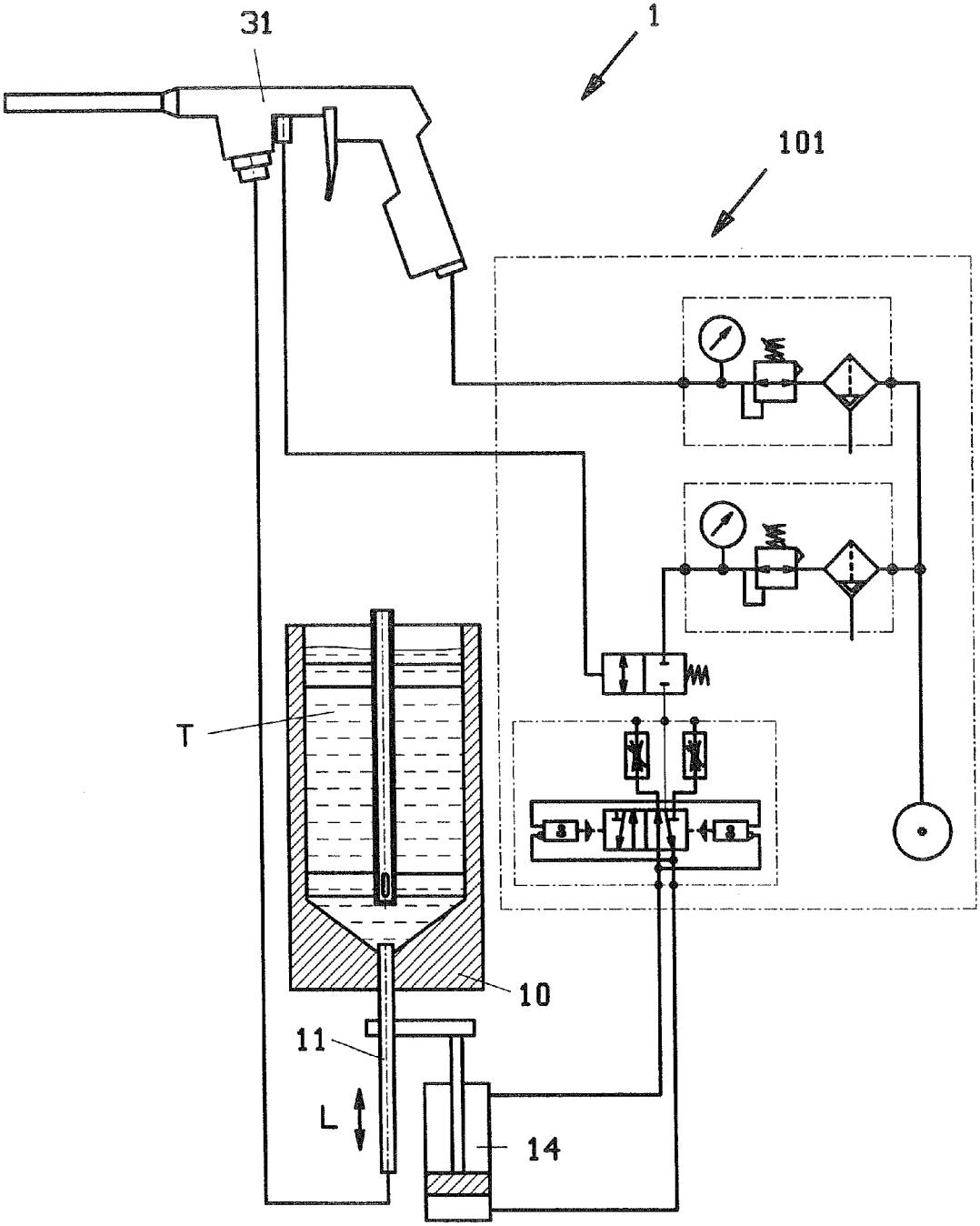
FIG. 1 shows a schematic illustration of a device for cleaning using dry ice pellets from the prior art.

The structure of a device 1 according to the invention for cleaning using dry ice is illustrated schematically in FIG. 1 and is also known from the prior art, for example from EP 1 769 88. The device 1 comprises a compressed air device 101, a storage container 10 for receiving dry ice T and a pneumatic cylinder 14 driven by the compressed air device 101. The dry ice T is located in the storage container 10 and is guided into a compressed air gun 31 by means of the compressed air device 101, said compressed air gun generating a negative pressure at an intake fitting 11. The dry ice T thus reaches an area to be cleaned at high speed ("blasting").

FIGS. 2 to 10 each show a detail of a device as shown in FIG. 1, but modified in accordance with the invention, in each case showing a storage container 10 provided with a vibrating means 102, scraping means 103 or a selecting element in a respective variant for conveying dry ice.

Figure 2:
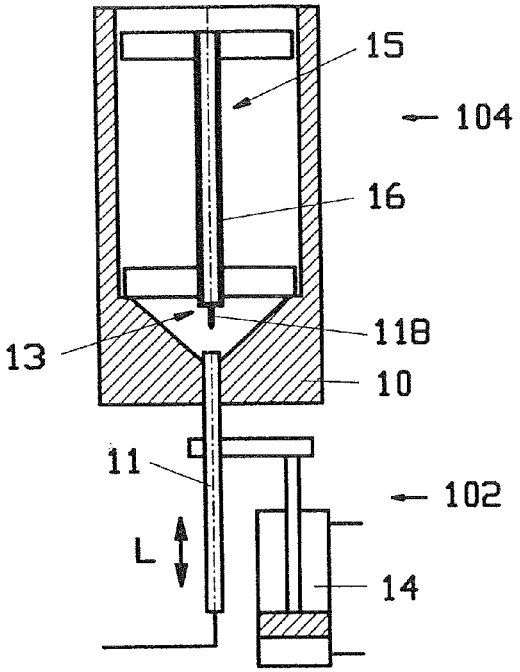
FIG. 2 shows a schematic illustration of the storage container of a device according to the invention for cleaning using dry ice pellets.

FIG. 2 shows the storage container 10 and, as a selecting element 104 for conveying pellets, a mixing element 15 with an air feed pipe 16, through which air is sucked up and in which ambient moisture can condense. Less ambient moisture therefore precipitates inside the container 10 and on the dry ice. The vibrating means 102 in this case comprises the pneumatic cylinder 14 connected to an intake fitting 11 that moves up and down along the longitudinal direction L. At the end of the upward movement, the intake fitting 11 contacts a contact face 13. Dry ice pellets located between the intake fitting 11 and the contact face 13 are comminuted due to the movement to and fro of the intake fitting 11 and are extracted through the intake fitting 11. A mandrel 118 ensures that no pellets become wedged in the intake fitting 11 and keeps free the outlet opening.

In the variant illustrated in FIG. 3*a*, an insert plate 105*a* with through-openings 106 is located as a selecting element 124 in the storage container 10. The insert plate 105*a* is provided with an impact member 107. The vibrating means 102 in this case comprises the pneumatic cylinder 14 connected to the intake fitting 11 that moves up and down along the longitudinal direction L. The insert plate 105*a* is vibrated as a result of the contact of the intake fitting 11 against the impact member 107. Dry ice snow located on the plate 105*a* is thus sieved through the through-openings 106 (not shown explicitly in the figure) and is extracted through the intake fitting 11. The impact member 107 may have an additional mandrel (not illustrated in the figure).

In the variant illustrated in FIG. 3*b*, an insert plate 105*b* with an impact member 107*b*, which additionally has a mandrel 118 reaching into the intake fitting 11, is located as a selecting element 124*b* in the storage container 10. The mandrel 118 is used to guide the to-and-fro movement, since the insert plate 105*b* has a smaller diameter than the inner opening of the storage container 10 in the cylindrical region. In the rest position, the insert plate 105*b* sits in the conical region of the storage container 10 and thus divides the container into two regions.

In the variant illustrated in FIG. 3*c*, an insert plate 105*c*, which has a greater thickness and therefore is solid and impact resistant, is located as a selecting element 124*c* in the storage container 10. An impact member is not necessary. The mandrel 118 reaching into the intake fitting 11 is fastened directly to the insert plate 105*c*. The insert plate 105*c* may have through-openings. In the present example, the diameter of the insert plate 105*c* is smaller than the inner diameter of the storage container 10 in the cylindrical region. The insert plate 105*c* has no through-openings, since the dry ice snow can slide past the insert plate 105*c* and into the intake fitting 11.

FIG. 4 shows a storage container of a device according to the invention, wherein a mixing element 15, connected to an inner container 109, for conveying dry ice pellets is provided as a selecting element 134. If the selecting element 134 is swapped, the rest of the pellets remaining in the inner container 109 are simultaneously removed from the device.

FIG. 5 shows a storage container of a device according to the invention, wherein an insert plate 105, connected to an inner container 109, for conveying dry ice snow is provided as a selecting element 144. If the selecting element 144 is swapped, the rest of the snow remaining in the inner container 109 is simultaneously removed from the device.

The inner container 109 is movable relative to the container 10. In particular, it is attached such that it has play relative to the storage container 10 so that the entire inner container 109 can be vibrated.

The vibrating means 102 in this case comprises the pneumatic cylinder 14 connected to the intake fitting 11 that moves up and down along the longitudinal direction L. The insert plate 105 is vibrated together with the inner container 109 due to the contact of the intake fitting 11 against the impact member 107. Dry ice snow located on the plate 105 is thus sieved through the through-openings 106 (not shown explicitly in the figure) and is extracted through the intake fitting 11.

In one embodiment of the invention, the storage container 10 may receive 2 L of dry ice, corresponding to 1 kg of dry ice snow or 1.5 kg of dry ice pellets. To this end, the storage container approximately has an inner diameter of 150 mm and a height of 160 mm.

To convey dry ice snow, an inner container 109 with an insert plate 105 is preferably fitted in the storage container 10. The inner container 109 comprises a cylindrical part 117 and a conical part 110, which are manufactured from polyethylene. The wall thickness of the inner container 109 is approximately 10 mm and the height of the conical part 110 is approximately 40 mm. The insert plate 105 is installed between the cylindrical part 117 and the conical part 110. The insert plate 105 is preferably a square woven mesh made of stainless steel with a mesh width of 3 mm.

If the pneumatic cylinder 14 is operated at a frequency of 1-20 Hz and ensures an axial movement amplitude of the inner container 109 of approximately 1-20 mm, the dry ice snow is thus conveyed at a rate of approximately 5-10 kg/h.

Instead of the inner container with an insert plate, a mixing element 15 as shown in FIG. 2 may be arranged as an alternative selecting element 104 in the storage container 10, or else a mixing element 15 attached in an inner container 109, as shown in FIG. 4. The device 1 can then be used to convey pellets.

By inserting a suitable selecting element, the device can thus be used both to clean sensitive areas (selecting element formed of an inner container with insert plate for conveying dry ice snow) and to clean highly soiled or less sensitive areas (selecting element formed of a mixing element for conveying dry ice pellets).

As a selecting element 154, FIG. 6 also shows a storage container 10 with an insert plate 105, which is supported by springs in this instance. The insert plate 105 is additionally provided with a bearing element, in this case a bearing ring 108. In particular, the bearing ring is not connected to the insert plate 105 and presses the upwardly moved plate 105 back downwards as a result of its gravitational effect. Since the ring is not connected to the plate, or at least is not rigidly connected to the plate, it is catapulted vertically upwardly as the plate 105 moves upwards. The fact that the ring 108 falls back onto the plate 105 ensures that said plate is again moved downward. As it falls back, the ring 108 impacts against the insert plate 105 and the jolt produced thereby allows dry ice arranged on the plate 105 to fall through the through-openings 106. At the same time, dry ice snow located between the ring 108 and plate 105 is pressed through the through-openings.

The bearing element 108 is preferably a ring made of metal or plastic, with a wall thickness between 5 and 20 mm, preferably approximately 10 mm, and a height between 40 and 60 mm, preferably approximately 50 mm.

The dry ice thus conveyed is extracted through the intake fitting 11.

In the variant illustrated in FIG. 7, the vibrating means 102 comprises a pneumatic cylinder 14. This is connected to an impact device that is effective from above, in the present example a hammer 114, which is movable up and down along the longitudinal direction L. The selecting element 164 in the present case is an insert plate 105 with through-openings 106. The insert plate 105 is vibrated as a result of the impact of the hammer 114 against the plate 105. Dry ice located on the plate is thus sieved through the plate 105 and is extracted through an intake fitting 11. Depending on the type and size of the through-openings and depending on the vibration frequency, dry ice snow or dry ice pellets can thus be conveyed selectively.

In the variant illustrated in FIG. 8, the vibrating means 102 comprises an ultrasound device 17. This is connected to an impact device that is effective from above and that moves a connecting rod up and down along the longitudinaldirection L. The selecting element 174 is an insert plate 105 with through-openings 106. The connecting rod is coupled directly to the insert plate 105, so that the insert plate 105 is vibrated in the event of movement of the rod. Dry ice snow located on the plate is thus sieved through the plate 105 and extracted through an intake fitting 11.

In the variant illustrated in FIG. 9, an inner container 109 that is movable relative to the container 10 is located as a selecting element 184 inside the storage container 10. In particular, the inner container 109 is attached such that it has play relative to the storage container 10 so that the entire inner container can be vibrated. The inner container 109 comprises a cylindrical upper part 117 and a conical lower part 110, which has as at least one outlet opening 116. The vibrating means 102 comprises a pneumatic cylinder 14 and is connected to an impact device, in the present example to a hammer 114, which acts from above on the inner container 109, in particular on the conical part 110. The hammer 114 is moved up and down along the longitudinal axis L by the pneumatic cylinder 14. The inner container 109 is vibrated as a result of the impact of the hammer 114 thereon, and dry ice located in the inner container 109 is conveyed through an outlet 116 in the conical part 110. The dry ice thus conveyed is extracted through an intake fitting 11.

In the variant illustrated in FIG. 10, an insert plate 105, preferably fastened in a sprung manner, with through-openings 106 is located as a selecting element 194 in the storage container. The device additionally comprises a scraping means 103, which in this case is connected to a drive 111 via a drive rod 112. The drive 111 thus drives a rasping tool 113 by means of the drive rod 112, for example in the manner of a passe-vite. The rasping tool 113 is in contact with an insert plate 105 having through-openings 106 and strips this insert plate 105. Dry ice located in the storage container 10 is conveyed through the insert plate 105 by means of the rasping tool 113 and is extracted through an intake fitting 11.

Different variants of through-openings are shown in FIG. 11. Image a) shows a square woven mesh, in which the gaps between a structure arranged in a grid-like manner form net-like through-openings 106*a*. The square woven mesh preferably has an open sieve area of 50-70%. For example, a square woven mesh having a mesh width of 3 mm, a wire diameter of 1 mm, a mesh number of 6.4 and an open screen area of 56% can be used.

In image b), square, rectangular, oval or honeycomb-shaped recesses in a plate form through-openings 106*b*1, 106*b*2, 106*b*3, 106*b*4.

In image c), circular recesses in a plate form circular through-openings 106*c*. A perforated plate is formed by the recesses.

As shown in image d) the recesses 106*d* can also be arranged as annular segments.

The recesses can be cut out, for example using a laser or water jet, or can be punched out.

FIG. 12 shows a device 1 according to the invention for cleaning using dry ice snow with an extraction device 115. In this case, the dry ice snow is blasted by means of the device 1 onto the surface, for example of a vehicle. At the same time, sublimated gas and detached dirt particles are extracted by means of the extraction device 115.

In an arrangement variant a), the device 1 and extraction device 115 are arranged such that the interior of the vehicle is cleaned. The device 1 and extraction device 115 are attached to opposite windows, which allows a flow of air, dry ice, particles and gas through the interior of the vehicle.

In the arrangement variant b), the device 1 and extraction device 115 are arranged such that the engine chamber of the vehicle is cleaned. The dry ice is in this case blasted into the engine chamber with the engine lid open. Air, dry ice, particles and gas are extracted from beneath the engine chamber by a means of the extraction device 115.

FIG. 13*a* shows a detail of a device as shown in FIG. 1, but modified, and shows a storage container 10 provided with a vibrating means 102 and selecting element 224 in a variant for conveying dry ice snow and dry ice pellets.

In the shown example, the selecting element 224 is a ball 205 freely movable in the storage container 110. The ball is moved by the intake fitting 11, which is movable to and fro, and rolls back in the direction of the intake fitting 11 due to the conical shape of the storage container 10.

The ball 205 may loosen up pellets and provides a contact face for the intake fitting, which can be moved against the ball 205 in such a way that dry ice pellets are comminuted between the contact face and the intake end of the intake fitting 11.

On the other hand, the moving ball 205 may counteract clumping of dry ice snow and may also be used to a certain degree for the portioning of dry ice snow that may travel past the ball 205 and reach the intake fitting.

For example for freshly produced dry ice snow and/or freshly produced dry ice pellets, the use of the ball 205 as a selecting element 224 may be sufficient to be able to convey both pellets and snow.

Dry ice snow can be conveyed particularly effectively if, as shown in FIG. 13*b*, the storage container 10 is equipped with a ball 205 and with an insert plate 105*d* having through-openings.

The insert plate 105*d* ensures that the ball 205 remains in the vicinity of the intake fitting and loosens the dry ice snow next conveyed in. At the same time, further dry ice snow is allowed to slide down. Dry ice snow that has been reliably loosened is thus conveyed.

The insert plate 105*d* can be connected fixedly to the storage container 10, loosely on a protrusion, as shown in the figure, or may rest on the inner face of the storage container 10 in the conical region.

The cleaning effect can be further improved if a blasting agent, such as glass, sand, plastic, corundum, steel, silicon carbide or calcium carbonate, is added to the dry ice; this is true both for cleaning using dry ice pellets and for cleaning using dry ice snow. To this end, the blasting agent can be mixed with the dry ice and conveyed together therewith. The blasting agent tends to trickle through the dry ice however. A greater proportion of blasting agent is therefore conveyed initially over the course of the blasting process and then decreases later.

It has therefore proven to be advantageous if the blasting agent is only added to the dry ice during the course of the blasting process.

FIG. 14*a* shows a schematic illustration of a storage container 10 of a further device according to the invention for cleaning using dry ice pellets and blasting agent, this device being analogous to the device shown in FIG. 2.

FIG. 14*a* shows the storage container 10 and a mixing element 15 as a selecting element 104 for conveying pellets. Air and blasting agent 120 are sucked up through the pipe 16. The blasting agent 120 reaches the storage container 10 through openings 119 in the pipe 26 and mixes above the intake fitting 11 with the pellets. The mixture is then extracted together through the intake fitting 11.

FIG. 14*b* shows a schematic illustration of a storage container 10 of a further device according to the invention for cleaning using dry ice snow and blasting agent, this device being analogous to the device shown in FIG. 3*a*.

In the variant illustrated in FIG. 14*b*, an insert plate 105*a* with through-openings 106 is located as a selecting element 124 in the storage container 10. The insert plate 105*a* is provided with a pipe 16. Air and blasting agent 120 are sucked up through the pipe 16. The blasting agent 120 reaches the storage container 10 through openings 119 in the pipe 16 and mixes above the intake fitting 11 with the dry ice snow, which slips through the openings 106 in the insert plate 105*a* when the intake fitting 11 moving to and fro impacts against the pipe 16 connected to the plate 105*a*.

The mixture is then extracted together through the intake fitting 11.

The invention claimed is:

1. A device for dispensing dry ice snow as a material to be conveyed, the device comprising:

a storage container for receiving dry ice, a compressed aft gun for dispensing dry ice, a conveying line connecting the storage container to the compressed air gun, and a vibrating means, wherein an insert plate with through-openings is located inside the storage container, the insert plate is arranged within and divides the storage container into two regions such that the dry ice snow lies on a flat surface of the insert plate and can fall through the through-openings of the insert plate, and wherein the insert plate can be vibrated by the vibrating means, the insert plate supports an impact member which engages with a movable impact device of the vibrating means, the vibrating means is a pneumatic cylinder, and the impact device also forms an intake fitting for the conveying line which connects the storage container with the compressed air gun for supplying the dry ice snow.

2. The device as claimed in claim 1, wherein the device comprises an extraction device (115) by which sublimated $CO_2$ gas and particles can be extracted.

3. The device as claimed in claim 1, wherein the insert plate comprises the impact member formed on a bottom surface thereof.

* * * * *